United States Patent [19]

Tenthoff

[11] Patent Number: 4,871,349

[45] Date of Patent: Oct. 3, 1989

[54] CENTRIFUGE FOR SEPARATING MIXTURES OF LIQUIDS

[75] Inventor: Aloys Tenthoff, Oelde, Fed. Rep. of Germany

[73] Assignee: Westfalia Separator AG, Oelde, Fed. Rep. of Germany

[21] Appl. No.: 295,418

[22] Filed: Jan. 10, 1989

[30] Foreign Application Priority Data

Jan. 27, 1988 [DE] Fed. Rep. of Germany ..... 3802306

[51] Int. Cl.[4] ..... B04B 11/00; B04B 15/06

[52] U.S. Cl. ..... 494/56; 494/64

[58] Field of Search ..... 494/56, 57, 58, 59, 494/64, 63, 60, 85, 12; 210/781, 782; 422/72

[56] References Cited

U.S. PATENT DOCUMENTS 1,749,291 3/1930 Lindgren ..... 494/56
2,174,272 9/1939 Lindgren ..... 494/57
2,197,911 4/1940 Andersson ..... 494/64
2,302,382 11/1942 Scott ..... 494/56
2,302,512 11/1942 Wilsmann ..... 494/56

*Primary Examiner*—Robert W. Jenkins
*Attorney, Agent, or Firm*—Sprung Horn Kramer & Woods

[57] ABSTRACT

A centrifuge for separating mixtures of liquids. The drum has an upper diversion chamber and a lower diversion chamber that divert the fractionated constituent of the liquid out of the drum and that are separated by a replaceable lid. At least one of the diversion chambers has a peeling structure that is provided with channels and an intake pipe that supplies the mixture of liquids. The drum can be equipped with another chamber lid and with another peeling structure with channels and an intake pipe. The channels in the second peeling structure open into the intake pipe and the second chamber lid unites the two diversion chambers into a single chamber.

1 Claim, 2 Drawing Sheets

CENTRIFUGE FOR SEPARATING MIXTURES OF LIQUIDS

BACKGROUND OF THE INVENTION

The invention concerns a centrifuge for separating mixtures of liquids, of which the drum has an upper diversion chamber and a lower diversion chamber that divert the fractionated constituents of the liquid out of the drum and that are separated by a replaceable lid, wherein at least one of the diversion chambers has a peeling structure that is provided with channels and an intake pipe that supplies the mixture of liquids.

A centrifuge drum of this type is known from German Pat. No. 3 136 627 for example. It is employed to separate mixtures of oil and water. The separated oil component is diverted through channels into the lower diversion chamber and the water component into the upper diversion chamber. The lower diversion chamber accommodates a peeling structure that diverts the separated oil under pressure. The separated water leaves the centrifuge drum unpressurized and is intercepted in the centrifuge hood.

The drum must be cleaned from time to time in order to maintain its output. Such cleaning is almost exclusively carried out by rinsing the drum with a rinse while the drum rotates at full speed. The rinse is kept circulating, which necessitates, in a drum of this type, intercepting the unpressurized rinse as it leaves the hood, combining it with the rinse leaving the peeling structure, and returning it to the drum. This requires at least one pump for the rinse that leaves the hood, which increases the installation cost. Since the drum needs to be cleaned out only every one to three months, it would be desirable to eliminate the expense of the pump.

SUMMARY OF THE INVENTION

The object of the present invention is to improve a centrifuge drum of the aforesaid type to the extent that the requisite costs of cleaning the drum will be substantially decreased.

This object is attained by the improvement wherein the drum can be equipped with another chamber lid and with another peeling structure with channels and an intake pipe, wherein the channels in the second peeling structure open into the intake pipe and the second chamber lid unites the two diversion chambers into a single chamber.

BRIEF DESCRIPTION OF THE DRAWING

The invention will now be specified with reference to the drawings, wherein.

DETAILED DESCRIPTION OF THE INVENTION

Figure 1:
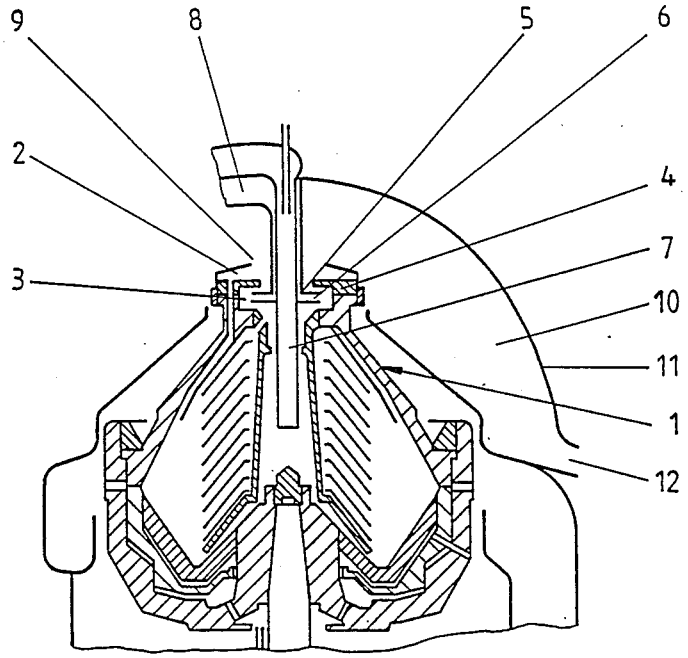
FIG. 1 illustrates a centrifuge drum at the state of the art.

The drum 1 of the centrifuge illustrated in FIG. 1 has an upper diversion chamber 2 and a lower diversion chamber 3 separated by a replaceable lid 4. Accommodated in lower diversion chamber 3 is a peeling structure 5 with channels 6 and with an intake pipe 7 at the center for supplying a mixture of liquids. The heavy component of the liquid is diverted out of upper diversion chamber 2, over a weir 9, and into a chamber 10 in a hood 11 that surrounds drum 1. Chamber 10 has an outlet 12.

Figure 2:
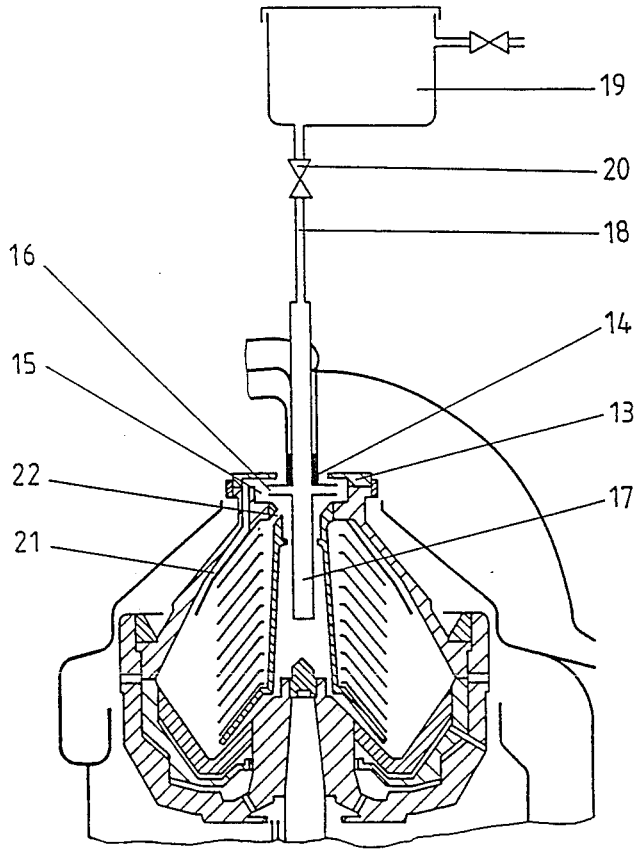
FIG. 2 represents the drum refitted for circulation rinsing.

When drum 1 is to be cleaned, it must be turned off and refitted as illustrated in FIG. 2. Lid 4 is replaced with another chamber lid 13 and peeling structure 5 with another peeling structure 14. Second chamber lid 13 is designed to create a single chamber 15 for diverting the separated liquid components. The fractionated components are accordingly combined in chamber 15. Second peeling structure 14 has channels 16 that open into an intake pipe 17. Intake pipe 17 communicates through a line 18 with a container 19 that accommodates the cleaning fluid.

Once drum 1 has been refitted, it is started up again. Cleaning concentrate is introduced manually into container 19 and the requisite amount of water or other liquid added. A valve 20 is opened to fill drum 1 with cleaning fluid through intake pipe 17. The cleaning liquid arrives in chamber 15 through channels 21 and 22 and thence, through the channels 16 in peeling structure 14, into intake pipe 17, resulting in uninterrupted circulation of the cleaning fluid in drum 1. The throughput of this circulatory system is dictated by the size of the channels 16 in peeling structure 14. The cleaning fluid is allowed to circulate for 1 to 2 hours, heating up in the process and resulting in thorough cleaning. The drum is then emptied and the cleaning process repeated if necessary. Finally, the drum is rinsed once or twice with clean water and refitted for normal operation.

The advantages of this type of cleaning are that no product is lost, no cleaning fluid can get into the product, and one cleaning device can be employed for several centrifuges of the same type.

It will be appreciated that the instant specifications and claims are set forth by way of illustration and not limitation, and that various modifications and changes may be made without departing from the spirit and scope of the present invention.

What is claimed is:

1. In a centrifuge having a drum for separating mixtures of liquids, of which the drum has an upper diversion chamber and a lower diversion chamber that divert fractionated constituents of the liquid out of the drum and that are separated by a removable lid, wherein at least one of the diversion chambers has a peeling structure with channels and an intake pipe that supplies the mixture of liquids, the improvement comprising: a cleaning assembly for substituting for the lid, intake pipe and peeling structure including a second chamber lid, a second peeling structure with second channels and a second intake pipe wherein the second channels in the second peeling structure open into the second intake pipe and the second chamber lid unites the two diversion chambers into a single chamber.

* * * * *